United States Patent [19]

Cook, Jr.

[11] 3,951,766

[45] Apr. 20, 1976

[54] ELECTROLYTIC CELL AND METHOD OF USING SAME

[75] Inventor: Edward H. Cook, Jr., Lewiston, N.Y.

[73] Assignee: Hooker Chemicals & Plastics Corporation, Niagara Falls, N.Y.

[22] Filed: Apr. 2, 1975

[21] Appl. No.: 564,529

Related U.S. Application Data

[63] Continuation-in-part of Ser. No. 494,110, Aug. 2, 1974, Pat. No. 3,882,002.

[52] U.S. Cl. ..... 204/98; 204/128; 204/252; 204/256; 204/290 F

[51] Int. Cl.[2] ..... C25B 1/14; C25B 1/16; C25B 1/26; C25B 11/10

[58] Field of Search ..... 204/290 F, 290 R, 291, 204/292, 98, 128, 96

[56] References Cited

UNITED STATES PATENTS

| | | | |
|---|---|---|---|
| 3,627,669 | 12/1971 | Entwisle et al. | 204/290 F |
| 3,711,385 | 1/1973 | Beer | 204/290 F X |
| 3,775,284 | 11/1973 | Bennett et al. | 204/290 F |
| 3,776,834 | 12/1973 | O'Leary | 204/290 F |
| 3,810,770 | 5/1974 | Bianchi et al. | 204/290 F |
| 3,865,703 | 2/1975 | Schenker et al. | 204/105 R |
| 3,878,084 | 4/1975 | Schultz et al. | 204/290 F |
| 3,884,792 | 5/1975 | McGilvery | 204/290 F |

*Primary Examiner*—T. Tung
*Assistant Examiner*—A. C. Prescott
*Attorney, Agent, or Firm*—Peter F. Casella; Herbert W. Mylius

[57] ABSTRACT

An improved electrolytic cell for the electrolysis of aqueous solutions of ionizable chemical compounds, and especially for the electrolysis of brines, comprises a cell equipped with a cathode and an anode separated by a permselective membrane diaphragm which is substantially impervious to liquids and gases, wherein the anode comprises a valve metal substrate such as titanium, a protective coating thereon of conductive tin oxide, and an outer coating of a noble metal or noble metal oxide.

17 Claims, No Drawings

ELECTROLYTIC CELL AND METHOD OF USING SAME

CROSS-REFERENCE TO RELATED APPLICATION

This application is a continuation-in-part application of U.S. application Ser. No. 494,110 filed Aug. 2, 1974, now U.S. Pat. No. 3,882,002.

This invention relates to an improved method and apparatus for the electrolysis of aqueous solutions of ionizable chemical compounds, and in particular to improved methods and apparatus for the production of halogens, such as chlorine, and alkali metal hydroxides, such as sodium hydroxide from the electrolysis of brines.

BACKGROUND OF THE INVENTION

The electrolysis of aqueous solutions of ionizable chemical compounds, particularly brines, in an electrolytic cell equipped with an anode and a cathode separated by a diaphragm is well-known in the art. A variety of materials have been tested and used as anodes in such electrolytic cells. In the past, the material most commonly used for this purpose has been graphite. However, the problems associated with the use of graphite anodes are several. The chlorine overvoltage of graphite is relatively high, in comparison for example with the noble metals. Furthermore, in the corrosive media of an electrochemical cell, graphite wears readily, resulting in substantial loss of graphite and the ultimate expense of replacement as well as continued maintenance problems resulting from the need for frequent adjustment of spacing between the anode and cathode as the graphite wears away. The use of noble metals and noble metal oxides as anode materials provides substantial advantages over the use of graphite. The electrical conductivity of the noble metals is substantially higher and the chlorine overvoltage substantially lower than that of graphite. In addition, the dimensional stability of the noble metals and noble metal oxides represents a substantial improvement over graphite. However, the use of noble metals as a major material of construction in anodes results in an economic disadvantage due to the excessively high cost of such materials.

In attempts to avoid the use of the expensive noble metals various other anode materials have been proposed for use as coatings over valve metal substrates. In U.S. Pat. No. 3,627,669, it is disclosed that mixtures of tin dioxide and oxides of antimony can be formed as adherent coatings on a valve metal substrate to form an anode useful in electrochemical processes. In the electrolytic production of chlorine, anodes of this type provide the advantage of economy in the elimination of the use of expensive noble metals or noble metal oxides. In addition the tin oxide coating provides an effective protection for the substrate. However, the tin oxide compositions, although useful as an anode material, exhibit a chlorine overvoltage that is substantially higher than that of the noble metals or noble metal oxides. Thus, despite the elimination of expensive noble metals, the cost of chlorine production, in processes using such anodes, is relatively high.

Considerable effort has been expended in recent years in attempts to develop improved anode materials and structures utilizing the advantages of noble metals or noble metal oxides. A great amount of effort has been directed to the development of anodes having a high operative surface area of noble metal or noble metal oxide in comparison with the total quantity of the material employed. This may be done, for example, by employing the noble metal as a thin film or coating over an electrically conductive substrate. However, when it is attempted to minimize the aforementioned economic disadvantage of the noble metals by applying them in the form of very thin films over a metal substrate, it has been found that such very thin films are often porous. The result is an exposure of the substrate to the anode environment, through the pores in the outer layer. In addition, in normal use in an electrolytic cell, a small amount of wear, spalling or flaking off of portions of the noble metal or noble metal oxide is likely to occur, resulting in further exposure of the substrate. Many materials, otherwise suitable for use as a substrate are susceptible to chemical attack and rapid deterioration upon exposure to the anode environment. In an attempt to assure minimum deterioration of the substrate under such circumstances, anode manufacturers commonly utilize a valve metal such as titanium as the substrate material. Upon exposure to the anodic environment titanium as well as other valve metals, will form a surface layer of oxide which serves to protect the substrate from further chemical attack. The oxide thus formed, however, is not catalytically active and as a result the operative surface area of the anode is decreased.

In the electrolytic cells of the prior art, it is known to provide a porous diaphragm separating the anode and the cathode and thereby minimizing the flow of liquids from the anode compartment to the cathode compartment of the cell. However, in most instances, such cells are operated under conditions such that ionic migration and molecular migration through the porous diaphragm occurs to a substantial degree resulting in the contamination of the cathode liquor with undecomposed electrolyte and of the anode liquor with reaction products of the cathodic materials and anodic materials. More recently it has been found that many of the disadvantages of the porous diaphragms of the prior art may be overcome through the use of membrane diaphragms which are impervious to both liquids and gases and which provide a control of both ionic and molecular migration during electrolysis. Such membrane diaphragms fabricated from synthetic organic ion-exchange resins are disclosed, for example in U.S. Pat. Nos. 2,967,807, 3,390,055, 3,852,135, and French Pat. No. 1,510,265. Among the resins disclosed for use as membrane diaphragms are included, for example, cation exchange resins of the "Amberlite" type, sulfonated copolymers of styrene and divinyl benzene and others.

It is also known from co-pending application Ser. No. 513,376 filed Oct. 9, 1974, that improved diaphragms for use in electrolytic cells may be prepared from a copolymer of tetrafluorethylene and a sulfonated perfluorovinyl ether. Diaphragms of this type represent a substantial advantage over the previously known membrane diaphragms with respect to retention of effectiveness, that is inertness to the electrolyte and products of the electrolysis, over extended periods of operation.

It is a primary object of this invention to provide a novel and improved electrolytic apparatus and method whereby electrolysis of aqueous solutions of ionizable chemical compounds may be carried out over extended periods of operation with improved efficiency and maintenance characteristics.

It is another object to provide a novel electrolytic apparatus utilizing as the anode thereof, an improved anode having an operative surface of noble metal or noble metal oxide and having improved efficiency and maintenance characteristics.

It is a further object of this invention to provide a novel electrolytic apparatus utilizing as the diaphragm a material which precludes or substantially reduces both molecular migration and undesirable ionic migration, but which still permits the conduction of electrical current by movements of desirable ions.

A further object is to provide novel electrolytic apparatus and process employing an improved permselective diaphragm and an improved anode, which can be operated efficiently over long periods without destruction of the diaphragm or rapid deterioration of the anode.

Other objects and advantages will be apparent to those skilled in the art on consideration of this specification and the appended claims.

SUMMARY OF THE INVENTION

This invention provides a novel electrolytic cell comprising an anode and a cathode and interposed therebetween, a diaphragm composed of a permselective membrane which is substantially impervious to liquids and gases. The anode of the electrolytic cell comprises a valve metal substrate, having a protective coating of conductive tin oxide on the surface thereof and an outer layer of a noble metal or noble metal oxide. The permselective diaphragm serves to control both ionic and molecular migration during electrolysis and eliminates or minimizes the contamination of the cathode liquor with undecomposed electrolyte and the anode liquor with reaction products of the cathodic and anodic materials. Anodes of the type employed herein having a protective intermediate coating of conductive tin oxide and an outer layer of noble metal or noble metal oxide, exhibit a high degree of durability in addition to the relatively low overvoltage characteristics of the noble metal or noble metal oxide, making them well suited for use in electrolytic processes.

Among the advantages of such anode construction is the protection afforded the metal substrate by the coating of conductive tin oxide. The preferred substrate materials of the anodes of the invention are the valve metals, such as titanium, tantalum, niobium or zirconium, especially titanium. However, where suitably thick intermediate layers of tin oxide are employed, other more conductive metals may be considered for use as substrates. The tin oxide coating, which may range in coating weight from about 0.1 grams per square meter to 100 grams per square meter or more, depending on the degree of protection desired, prevents contact of the substrate and the electrolyte, thus preventing or minimizing corrosion or surface oxidation and the attendant deterioration or passivation of the substrate. At the same time, the outer layer provides the advantageous catalytic properties of the noble metals or noble metal oxides. In addition, the protective layer of conductive tin oxide permits the use of a relatively thin layer of the noble metal or noble metal oxide and a consequent savings resulting from a minimal use of the precious metal. Typically, the layer of noble metal or noble metal oxide will have a coating weight in the range of about 0.1 grams per square meter to about 20 grams per square meter or higher and preferably about 3 to 10 grams per square meter in thickness. The disadvantage of pores and pinholes in the noble metal layer common in extremely thin layers is obviated by the presence of the intermediate layer of conductive tin oxide. Pores or pinholes in the noble metal layer, or wearing away of that outer layer over long periods of use result in the gradual exposure of the tin oxide layer. The intermediate layer of tin oxide will continue to provide a catalytically active surface in those exposed areas. The catalytic characteristics of tin oxide, although not as high as the noble metals or noble metal oxides, is quite substantially higher than the valve metal oxide. Thus, the overall deterioration of the catalytic properties of the anode is more gradual and maintenance problems are accordingly lessened.

In addition, it has been found that the intermediate layer of tin oxide provides an increase in surface area of the anode with a consequent improvement in overvoltage. It has further been found that the adhesion of the noble metal or noble metal oxide to the substrate is increased by the presence of the intermediate layer of tin oxide and the problem of spalling of the surface layer is thereby reduced.

The cathode of the electrolytic cell of this invention may be formed of an electrically conductive material which is resistant to attack under conditions of electrolysis. Thus, for example, a cathode of graphite, iron, or steel, other electrically conductive, resistant material may be employed.

In the electrolytic cell apparatus of the present invention, the anode, as described hereinabove, and the cathode are separated by a permselective membrane. The permselective membrane thus serves to divide the cell unit into two compartments, an anode compartment and a cathode compartment and to serve as a substantial barrier to the flow of fluids between the two compartments while selectively permitting the transfer of ions. Various permselective membranes may be employed for this purpose. For example, there may be employed membranes of the Amberlite type sulfonated copolymers of styrene and divinyl benzene and the like, such as those disclosed in U.S. Pat. Nos. 2,967,807, 3,390,065, and French Pat. No. 1,510,265.

In addition, there may be employed membranes prepared by the addition of a fluorinated vinyl compound to an inert polymeric film and then sulfonating the film. For example, in co-pending application, Ser. No. 535,636, is disclosed that such membranes may be prepared by the process of radiation grafting of a fluorinated vinyl compound such as $\alpha$, $\beta$, $\beta$-trifluorostyrene onto an inert film of a polymer such as a polymer of ethylene, propylene, tetrafluoroethylene, tetrafluorochloroethylene and other halogenated olefinically unsaturated monomers, preferably having 2–3 carbon atoms, or a film of a copoylmer of these monomers such as copolymers tetrafluoroethylene-hexafluoropropylene and tetrafluoroethylene-ethylene, and then sulfonating the membrane.

A preferred permselective membrane for use in the electrolytic cell of this invention comprises a hydrolyzed copolymer of tetrafluoroethylene and a sulfonated perfluorovinyl ether of the formula:

$$FSO_2CF_2CF_2OCF(CF_3)CF_2OCF{=}CF_2$$

the copolymer having an equivalent weight of from about 900 to 1600. Preferably the equivalent weight of the copolymer is from about 1100 to 1400.

Copolymers of the character referred to above are prepared as disclosed in U.S. Pat. No. 3,282,875, by reacting, at a temperature below about 110° C, a perfluorovinyl ether of the formula $$FSO_2CF_2CF_2OCF(CF_3)CF_2OCF{=}CF_2$$

with tetrafluoroethylene in an aqueous liquid phase, preferably at a pH below 8, and in the presence of a free-radical initiator such as ammonium persulfate, and subsequently hydrolyzing the acyl fluoride groups to the free acid or salt form by conventional means.

The electrolytic cell of this invention, comprising an anode of the type described hereinabove, and a cathode separated by a permselective membrane diaphragm, may be suitably contained in a housing or outer casing formed of any electrolytically nonconductive material which is resistant to chlorine, hydrochloric acid and caustic alkali and which will withstand the temperatures at which the cell may be operated. Typically, these temperatures are from about 65 to 95° C. Exemplary of the materials which may be used are high temperature polyvinyl chloride, hard rubber, chlorendic acid based polyester resins, and the like. It will be appreciated that the materials of construction for the housing preferably have sufficient rigidity as to be self-supporting. Alternatively, however, the housing may be formed of a material which does not fulfill all the above-mentioned criteria, such as concrete or cement, which materials are not resistant to hydrochloric acid and chlorine, and have the interior exposed areas of such members coated with a material which does fulfill these requirements. Additionally, even in the case of materials which are substantially self-supporting, such as rigid polyvinyl chloride, it is desirable on occasion such as in the instance of relatively large installations to provide reinforcing members around the exterior of the member, such as metal bands, to provide additional rigidity.

DESCRIPTION OF THE PREFERRED EMBODIMENTS

The metal substrate which forms the inner or base component of the anode is an electroconductive metal having sufficient mechanical strength to serve as a support for the coating and preferably having a high degree of chemical resistivity, especially to the anodic environment of electrolytic cells. The preferred substrate material is a valve metal. Typical valve metals include, for example, Ti, Ta, Nb, Zr, and alloys thereof. The valve metals are well known for their tendency to form an inert oxide film upon exposure to an anodic environment. The preferred valve metal, based on cost and availability as well as electrical and chemical properties as titanium. The conductivity of the substrate may be improved, if desired, by providing a central core of a highly conductive metal such as copper. In such an arrangement, the core must be electrically connected to and completely protected by the valve metal substrate.

Tin oxide can be readily formed as an adherent coating on a valve metal substrate, in a manner described hereinafter, to provide a protective, electrically conductive layer which is especially resistant to chemical attack in anodic environments. Pure tin oxide however has a relatively high electrical resistivity in comparison to metals and exhibits undesirable change in electrical resistivity as a function of temperature. It is well known that the electrical stability of tin oxide coatings may be substantially improved and the electrical resistivity lowered through the introduction of a minor proportion of a suitable inorganic material (commonly referred to as a "dopant"). A variety of materials, especially various metal oxides and other metal compounds and mixtures thereof, have been disclosed in the prior art as suitable dopants for stabilizing and lowering the electrical resistivity of tin oxide compositions. Among the materials shown in the prior art to be useful as dopants in conductive tin oxide compositions and which may be employed in the tin oxide coating compositions of the anodes of this invention are included, for example, fluorine compounds, especially the metal salts of fluorine, such as sodium fluoride, potassium fluoride, lithium fluoride, berylium fluoride, aluminum fluoride, lead fluoride, chromium fluoride, calcium fluoride, and other metal fluorides; hydrazine, phenylhydrazine; phosphorous compounds such as phosphorus chloride, phosphorus oxychloride, ammonium phosphate, organic phosphorus esters such as tricresyl phosphate; as well as compounds of tellurium, tungsten, antimony, molybdenum, arsenic, and others and mixtures thereof. The conductive tin oxide coatings of this invention comprise tin oxide, preferably containing a minor amount of a suitable dopant. The preferred dopant is an antimony compound which may be added to the tin oxide coating composition either as an oxide or as a compound such as $SbCl_3$ which may form the oxide when heated in an oxidizing atmosphere. Although the exact form of the antimony in the final coating is not certain, it is assumed to be present as $Sb_2O_3$ and data and proportions in this specification and the appended claims are based on that assumption. The preferred compositions of this invention comprise mixtures of tin oxide and a minor amount of antimony oxide, the latter being present preferably in an amount of between about 0.1 and 20 weight percent (calculated on the basis of total weight of $SnO_2$ and $Sb_2O_3$).

Conductive tin oxide coatings may be adherently formed on the surface of the valve metal substrate by various methods known in the art. Typically such coatings may be formed by first chemically cleaning the substrate, for example, by degreasing and etching the surface in a suitable acid, e.g., oxalic acid, then applying a solution of appropriate thermally decomposable salts, drying and heating in an oxidizing atmosphere. The salts that may be employed include, in general, any thermally decomposable inorganic or organic salt or ester of tin and dopant, e.g., antimony, including for example their chlorides, alkoxides, alkoxy halides, resinates, amines and the like. Typical salts include for example, stannic chloride, dibutyltin dichloride, tin tetraethoxide, antimony trichloride, antimony pentachloride and the like. Suitable solvents include for example, ethyl alcohol, propyl alcohol, butyl alcohol, pentyl alcohol, amyl alcohol, toluene, benzene and other organic solvents as well as water.

The solution of thermally decomposable salts, containing for example, a salt of tin and a salt of antimony, or other dopant, in the desired proportions, may be applied to the cleaned surface of the valve metal substrate by painting, brushing, dipping, rolling, spraying or other method. The coating is then dried by heating for example at about 100° to 200° C for several minutes to evaporate the solvent, and then heating at a higher temperature, e.g., 250° to 800° C in oxidizing atmosphere to convert the tin and antimony compounds to their respective oxides. The procedure may be repeated as many times as necessary to achieve a desired coating weight or thickness. The final coating weight of this conductive tin oxide coating may vary considerably, but is preferably in the range of about 3 to about 30 grams per square meter.

Optionally, a small amount, such as up to 3 percent by weight of a chlorine discharge catalyst such as at least one of the difluorides of manganese, iron, cobalt or nickel may be included in the tin oxide coating to lower the overpotential required for chlorine gas liberation in a chlor-alkali cell. The chlorine discharge catalyst may be added to the tin oxide coating by suspending a fine particulate preformed sinter of tin dioxide and the catalyst in the solution of thermally decomposable salts. Such chlorine discharge catalysts in the tin oxide coating is not essential to the anodes of this invention but may be employed if desired in a known manner such as disclosed in U.S. Pat. No. 3,627,669.

The outer coating of the anode comprises a noble metal or noble metal oxide such as platinum, iridium, rhodium, palladium ruthenium or osmium or mixtures or alloys of these metals or the oxides or mixtures of the oxides of these metals. An outer coating of a noble metal may be applied by known methods such as electroplating, chemical deposition from a platinum coating solution, spraying, or other methods.

Preferably, the outer coating of the anode comprises a noble metal oxide. Noble metal oxide coating may be applied by first depositing the noble metal in the metallic state and then oxidizing the noble metal coating, for example, by galvanic oxidation or chemical oxidation by means of an oxidant such as an oxidizing salt melt, or by heating to an elevated temperature, e.g., 300° to 600°C or higher in an oxidizing atmosphere such as air or oxygen, at atmospheric or super-atmospheric pressures to convert the noble metal coating to a coating of the corresponding noble metal oxide. Other suitable methods include, for example, electrophoretic deposition of the noble metal oxide; or application of a dispersion of the noble metal oxide in a carrier, such as alcohol, by spraying, brushing, rolling, dipping, painting, or other method on to the tin oxide surface followed by heating at an elevated temperature to evaporate the carrier and sinter the oxide coating. A preferred method for the formation of the noble metal oxide coating involves coating the conductive tin oxide surface with a solution of a noble metal compound, evaporating the solvent and converting the coating of noble metal compound to the oxide by chemical or electrochemical reaction. For example, the conductive tin oxide surface may be coated with a solution of a thermally decomposable salt of a noble metal, such as a solution of a noble metal halide in an alcohol, evaporation of the solvent, followed by heating at an elevated temperature such as between about 300° and 800° C in an oxidizing atmosphere such as air or oxygen for a period of time sufficient to convert the noble metal halide to a noble metal oxide. The procedure for formation of a noble metal or noble metal oxide coating may be repeated as often as necessary to achieve the desried thickness. The foregoing and other methods for the preparation of coatings of noble metals and noble metal oxides on the surface of anodes for use in electrolytic cells are well known in the art and may be found for example in U.S. Pat. No. 3,711,385.

When sodium chloride solutions are electrolyzed in the electrolytic cell of this invention, the permselective membrane of the type described hereinabove, provides a diaphragm structure which is substantially impervious to liquids and gases and in characterized by a charged network of negative ions or aggregates of negative ions electrically balanced by a number of positive ions which are free to move in and through the structure, that is, a cation-active diaphragm. Thus, when the cathode compartment is initially charged with water or dilute aqueous sodium hydroxide, the anode compartment being charged with sodium chloride solution, chloride ions will be attracted to the anode and discharged thereat. Sodium ions will pass through the diaphragm whereas chloride ions and sodium chloride will be substantially barred by the impervious diaphragm from entering into the cathode compartment. Since essentially only sodium ions pass through the diaphragm and are discharged at the cathode, essentially salt free sodium hydroxide is produced in the cathode compartment. Similarly, when employing the cation active diaphragm in accordance with this invention, hydroxyl ions are effectively prevented from migrating from the cathode compartment through the diaphragm into the anode compartment. The current will therefore be carried substantially exclusively by the sodium ions from the anode to the cathode and the difficulties caused by the back migration of the hydroxyl ions are substantially eliminated by the process of this invention.

The utilization of the preferred permselective membrane diaphragms, that is, membrane diaphragms of a hydrolyzed copolymer of tetrafluoroethylene and a sulfonated perfluorovinyl ether, as described hereinabove results in the advantages of low voltage drop in the cell, production of highly pure, i.e., essentially salt free, caustic soda, operation of the cell at relatively low cell voltage, high current efficiency and, especially at lower caustic concentrations in the catholyte liquor, in high caustic efficiency. Moreover, because of the compatibility of the permselective membrane in both chlorine and caustic alkaline environments at elevated temperatures, e.g., about 80° to 110° C the membranes can be maintained in continuous service for extended periods, surprisingly longer than the permselective membranes of the prior art processes.

The diaphragms useful in the practice of the present invention can advantageously be prepared and utilized in the form of a thin film, either as such or deposited on an inert support, such as a cloth woven of Teflon or glass fibers. The thickness of the supported membrane can be varied over a considerable range for example, from about 5 to 15 mils in thickness.

A wet 10 mil thick membrane of the character disclosed herein exhibits an electrolytic resistivity such that when inserted in an operating chloralkali cell with a 0.25 inch gap between the anode and cathode, the voltage will increase only from about 0.5 to about 0.7 volts per ampere square inch in the range of 0.5 to 3 amperes per square inch.

The diaphragm can be fabricated in any desired shape. As generally prepared the copolymer is obtained in the form of the sulfonyl fluoride. In this non-acid form the polymer is relatively soft and pliable, and can be seam- or butt- welded forming welds which are as strong as the membrane material itself. It is preferred that the polymeric material be shaped and formed in the non-acid state. Following shaping or forming into the desired membrane configuration, the material is conditioned for use by hydrolyzing the sulfonyl fluoride groups to free sulfonic acid or sodium sulfonate groups by boiling in water or caustic alkaline solutions. On boiling in water for about 16 hours, the conditioned membrane material undergoes swelling, about 28 percent, which is isotropic, about 9 percent in each direction. When exposed to brine, the swelling is reduced to about 22 percent which results in a net tightening of the membrane in use. The conditioning process can be carried out either out of the cell or with the diaphragm in place in the cell.

The following specific examples will serve to further illustrate this invention. In the examples, and elsewhere in this specification and claims, all temperatures are in degrees Celsius and all parts and percentages are by weight unless otherwise indicated.

EXAMPLE 1

Preparation of the Anode

1A. Preparation of conductive tin oxide coating

A strip of titanium plate was prepared by immersion in hot oxalic acid for several hours to etch the surface, then washed and dried. The titanium was then coated with a composition of tin oxide doped with antimony oxide, following the procedure of Example 4 of U.S. Pat. No. 3,627,669, in the following manner:

Tin dioxide was prepared by dissolving metallic tin (84 parts) in concentrated nitric acid and heating until tin dioxide was precipitated. Antimony trioxide (18 parts) was boiled in concentrated nitric acid until evolution of nitrogen oxides ceased, then thoroughly mixed with the precipitated tin oxide. The mixture was further treated with hot nitric acid, then washed free of acid and air dried at about 200°C. About 3 percent by weight of manganese difluoride was added and mixed with the dried mixed oxides. The mixture was then compressed into pellets, heated in air at about 800°C for 24 hours, then crushed and reduced to a particle size of less than 60 microns. The crushed mixed oxide composition was again pelletized and heated as before and then crushed and ball-milled to a particle size of less than 5 microns.

An antimony trichloride-alkoxy-tin solution was prepared by boiling at reflux conditions for 24 hours a mixture of 15 parts of stannic chloride and 55 parts of n-amyl alcohol then dissolving therein 2.13 parts of antimony trichloride.

A suspension of 0.17 parts of the mixed oxide composition in 3.6 parts of the antimony trichloride-alkoxy-tin solution was prepared and painted on to the clean titanium surface and the coating was oven-dried at 150°C. Two additional coats of the same composition were similarly applied and dried after which the coated strip was heated in air at 450°C for about 15 minutes to convert the coating substantially to oxides of tin and antimony with manganese fluoride. The coating operation, including the final heating at 450°C was repeated three times to increase the thickness of the coating.

The theoretical composition of the conductive coating thus prepared, was 85.6 percent $SnO_2$; 13.7 percent antimony oxides (calculated as $Sb_2O_3$); and 0.7 percent $MnF_2$. The coating weight of the finished coating was 21.2 grams per square meter.

1B. Preparation of $RuO_2$ Coating

The conductive tin oxide coated titanium was further coated in the following manner:

A solution of 1 gram of ruthenium trichloride in 0.4 cubic centimeters of 36% hydrochloric acid and 6.2 cubic centimeters of butyl alcohol was brushed several times onto the tin oxide surface and then allowed to dry in air at room temperature. After drying, the samples were heated in air at 560° C for 25 minutes to decompose the $RuCl_3$ and form $RuO_2$. An additional coating of $RuCl_3$ was similarily applied, dried and thermally treated, to yield a final coating of $RuO_2$ having a coating weight of about 6.0 grams of ruthenium per square meter.

In the foregoing Example, a minor proportion of a chlorine discharge agent, manganese difluoride was incorporated in the conductive tin oxide coating. An anode may also be prepared in accordance with this invention, following the procedure of Example 1 except that no chlorine discharge agent is added.

EXAMPLE 2

Preparation of Cation-active Permselective Membrane

A film of copolymer of tetrafluoroethylene and sulfonated perfluorovinyl ether, containing sulfonyl fluoride groups, and having an equivalent weight of about 1100 was prepared according to the procedure of U.S. Pat. No. 3,282,875. The copolymer film, thus prepared, was conditioned for use by soaking in boiling water for about 16 hours to hydrolyze the sulfonyl fluoride groups to free sulfonic acid. The membrane, thus prepared, was a 10 mil thick film of a hydrolyzed copolymer of tetraflurorethylene and sulfonated perfluorovinyl ether characterized by the formula $$FSO_2CF_2CF_2OCF(CF_3)CF_2OCF{=}CF_2$$

and having an equivalent weight of about 1,100.

EXAMPLE 3

Chlorine Cell Test

The anode, prepared as described in Example 1B, was installed and tested as an anode in a chlorine cell having a steel cathode separated from the anode by a cationic membrane prepared as described in Example 2. The anode compartment was supplied with preheated brine having a composition of about 310 g/l NaCl and pH of about 4.5. The anolyte was maintained at about 95° C. The test was conducted at a constant current density of 310 ma/cm$^2$ (2.0 ASI). The anode exhibited a potential of 1.19 volts (v. a saturated calomel electrode) which potential remained stable during an extended test period.

For purposes of comparison, a commercially available anode composed of a titanium substrate having a coating of ruthenium oxide directly on the surface thereof was installed and tested under identical conditions. The anode exhibited a potential of 1.26 volts (v. a saturated calomel electrode). Thus, it will be seen that an improvement in overvoltage is achieved in anodes, such as the anode of Example 1B, where the outer coating of noble metal oxide is deposited on the surface of a layer of conductive tin oxide rather than directly on the surface of the valve metal substrate.

EXAMPLE 4

An anode prepared in accordance with Example 1B, that is, an anode consisting of a titanium substrate, an outer coating of ruthenium oxide, and an intermediate layer of conductive tin oxide, was tested in comparison with an anode prepared in accordance with Example 1A, that is, an anode consisting of a titanium substrate, and a coating of conductive tin oxide. The anodes were installed and tested under identical conditions in a chlorine cell having a steel cathode, separated from the anode by a cationic membrane prepared as described in Example 2. The anode compartment was supplied with preheated brine having a concentration of about 310 grams of NaCl per liter and a pH of about 4.5. The anolyte was maintained at about 95° C and the test was conducted at a constant current density of 310 ma/cm² (2.0 ASI). The anode of Example 1B exhibited an initial potential of about 1.20 volts (v. a saturated calomel electrode), the potential remaining essentially constant over a 127 hour test period. Under identical test conditions, the anode of Example 1A exhibited an initial potential of about 1.52 volts (v. a saturated calomel electrode), the potential rising to 1.76 volts over the 128 hour test period.

EXAMPLE 5

A. A sample of titanium mesh was coated with a layer of conductive tin oxide following the procedure of Example 1A.

B. A sample of titanium mesh coated with conductive tin oxide as described in Example 1A was further coated with an outer layer of ruthenium dioxide following the procedure of Example 1B.

The mesh anodes, prepared as described in A and B above, were installed and tested as anodes in chlorine cells wherein the electrode gap between the anode and a steel cathode was one-eighth inch and the anode and cathode were separated by a cationic membrane prepared as described in Example 2. The cells were operated with anolyte concentrations ranging from 250 to 310 grams NaCl/liter at a pH of 4.5, and temperatures ranging from 80° to 90° C. The tests were conducted at a constant current density of 310 ma/cm² (2.0 ASI). The anode of Example 1B exhibited an initial potential of about 1.32 v and remained substantially stable over a 60 day period of operation whereas the anode of Example 1A exhibited an initial potential of about 1.50 volts, and the potential rose gradually to about 1.90 on the 50th day of operation, then rose very rapidly on the 52nd day and achieved complete passivation on the 55th day.

EXAMPLE 6

An anode was prepared in accordance with Example 1, by coating a 30 inch tall by 2 inch wide titanium mesh first with a layer of conductive tin oxide and then with an outer coating of ruthenium oxide. The anode and a cathode comprising a foraminous steel sheet of similar size, were installed in an electrolytic cell for the production of chlorine and caustic. The anode and cathode were separated by a cationic membrane prepared as described in Example 2. The anode to cathode gap was about 0.125 inch. The cell was operated for 200 days at 120 amperes at a voltage of 3.75 to 4.0 volts. Sodium chloride brine containing 250 to 310 grams per liter of sodium chloride was circulated through the anolyte compartment. Deionized water was fed to the catholyte compartment. The cell temperature was maintained at 70° to 90° C. Sodium hydroxide solution at a concentration of 105 to 130 grams per liter was produced at 90% current efficiency. The salt content of the caustic produced was less than 0.5 percent. After the 200 day test, the anode showed no sign of degradation.

What is claimed is:

1. An electrolytic cell comprising an anode and a cathode separated by a cation-active permselective membrane which is substantially impervious to liquids and gases, wherein the anode comprises a valve metal substrate, a coating thereon of electroconductive tin oxide, and an outer coating of at least one of a noble metal or noble metal oxide.

2. An electrolytic cell according to claim 1 wherein said valve metal substrate is titanium.

3. An electrolytic cell according to claim 2 wherein said electroconductive tin oxide comprises a mixture of tin dioxide and a minor amount of antimony oxide.

4. An electrolytic cell according to claim 2 wherein said outer coating is a noble metal oxide.

5. An electrolytic cell according to claim 4 wherein said outer coating is ruthenium oxide.

6. An electrolytic cell according to claim 5 wherein said electroconductive tin oxide comprises a mixture of tin oxide and between about 0.1 and about 20 percent by weight of antimony oxide, based on the total weight of said mixture when calculated as $SnO_2$ and $Sb_2O_3$.

7. An electrolytic cell according to claim 1 wherein said permselective membrane consists essentially of a hydrolyzed copolymer of tetrafluoroethylene and a sulfonated perfluorovinyl ether characterized by the formula $$FSO_2CF_2CF_2OCF(CF_3)CF_2OCF{=}CF_2$$

said copolymer having an equivalent weight of about 900 to about 1,600.

8. An electrolytic cell according to claim 7 wherein said copolymer has an equivalent weight of about 1,100 to about 1,400.

9. An electrolytic cell according to claim 7 wherein said valve metal substrate is titanium.

10. An electrolytic cell according to claim 9 wherein said electroconductive tin oxide comprises a mixture of tin oxide and a minor amount of antimony oxide.

11. An electrolytic cell according to claim 9 wherein said outer coating is a noble metal oxide.

12. An electrolytic cell according to claim 11 wherein said outer coating is ruthenium oxide.

13. An electrolytic cell according to claim 12 wherein said electroconductive tin oxide comprises a mixture of tin oxide and between about 0.1 and about 20 percent by weight of antimony oxide, based on the total weight of said mixture when calculated as $SnO_2$ and $Sb_2O_3$.

14. A method for the electrolytic decomposition of aqueous solutions of ionizable chemical compounds which comprises electrolyzing an aqueous solution of an ionizable chemical compound in an electrolytic cell having an anode and a cathode separated by a permselective membrane which is substantially impervious to liquids and gases, and is a hydrolyzed copolymer of tetrafluorethylene and a sulfonated perfluorovinyl ether characterized by the formula $$FSO_2CF_2CF_2OCF(CF_3)CF_2OCF{=}CF_2$$

and having an equivalent weight of about 900 to about 1,600; and said anode comprises a valve metal substrate, a coating of electroconductive tin oxide on the surface thereof and an outer coating, on the surface of the electroconductive tin oxide, of at least one of a noble metal or noble metal oxide.

15. A method according to claim 14, wherein the anode comprises a titanium substrate, a coating thereon of electroconductive tin oxide and an outer coating of ruthenium oxide.

16. A method according to claim 15 wherein the electroconductive tin oxide comprises a mixture of tin oxide and between about 0.1 and about 20 percent by weight of antimony oxide, based on the total weight of the mixture when calculated as $SnO_2$ and $Sb_2O_3$.

17. A method according to claim 16 wherein the ionizable chemical compound is sodium chloride.

* * * * *